United States Patent [19]

Berkeley et al.

[11] Patent Number: 4,837,982

[45] Date of Patent: Jun. 13, 1989

[54] CONTROL CIRCUIT FOR A HONING MACHINE

[75] Inventors: James E. Berkeley; Timothy D. Franck, both of Cedar Rapids, Iowa

[73] Assignee: Kwik-Way Manufacturing Corporation, Marion, Iowa

[21] Appl. No.: 127,371

[22] Filed: Dec. 2, 1987

[51] Int. Cl.[4] ..... B24B 49/08; B24B 5/08

[52] U.S. Cl. ..... 51/165.9; 51/34 H; 51/34 J

[58] Field of Search ..... 51/34 R, 34 D, 34 H, 51/34 J, 165.9

[56] References Cited

U.S. PATENT DOCUMENTS

| | | | |
|---|---|---|---|
| 2,390,495 | 12/1945 | Caldwell | 51/34 D |
| 2,515,531 | 7/1950 | Seborg | 51/34 D |
| 2,791,871 | 5/1957 | Johnson | 51/34 R |
| 4,173,847 | 11/1979 | Gehring et al. | 51/34 J |
| 4,510,720 | 4/1985 | Westberg | 51/34 J |
| 4,550,530 | 11/1985 | Rottler et al. | 51/34 R |
| 4,621,457 | 11/1986 | Moyer | 51/34 H |

*Primary Examiner*—Frederick R. Schmidt
*Assistant Examiner*—Jack Lavinder
*Attorney, Agent, or Firm*—Hill, Van Santen, Steadman & Simpson

[57] ABSTRACT

A control circuit for a honing machine such that the honing head can be driven and the machine manually operated by an operator or, alternatively, the unit can be placed in the auto stroke mode such that a pair of limit switches control the up and down honing operation of the system. The limit switches actuate a number of solenoid valves which cause the honing head to be moved up and down in a cylinder automatically. By setting the position of a pair of trip discs, the travel limits can be set for the system.

3 Claims, 2 Drawing Sheets

CONTROL CIRCUIT FOR A HONING MACHINE

BACKGROUND OF THE INVENTION

1. Field of the Invention

This invention relates in general to a cylinder honing control circuit for automatic honing control.

2. Description of the Prior Art

Prior art honing control circuits utilize hydraulic circuits which have a pivot arm having a relatively slow stroking speed.

SUMMARY OF THE INVENTION

The present invention relates to a control circuit for a cylinder honing machine for automatic honing control. The present invention has the following advantages over air/hydraulic circuits which are:

1. Elimination of the hydraulic circuit which simplifies manufacturing.

2. Elimination of the hydraulic circuit enables the pivot arm which moves the honing head to have a greater range of stroking speeds.

3. The use of two cylinders in opposition increases the operating power on the pivot arm and equalizes the force about the pivot.

4. Trip discs are provided which can be adjusted while the machine is in operation; and 5. Air valves allow the system to be pressurized prior to engagement of the auto stroke circuit. This is critical to prevent a surge in the system when first starting up and this is the secret to the success of the system.

The invention comprises four solenoid operated air valves in combination with other elements so as to allow either manual or automatic operation of a pivoted lever arm which controls a honing head motor for honing cylinders, for example.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
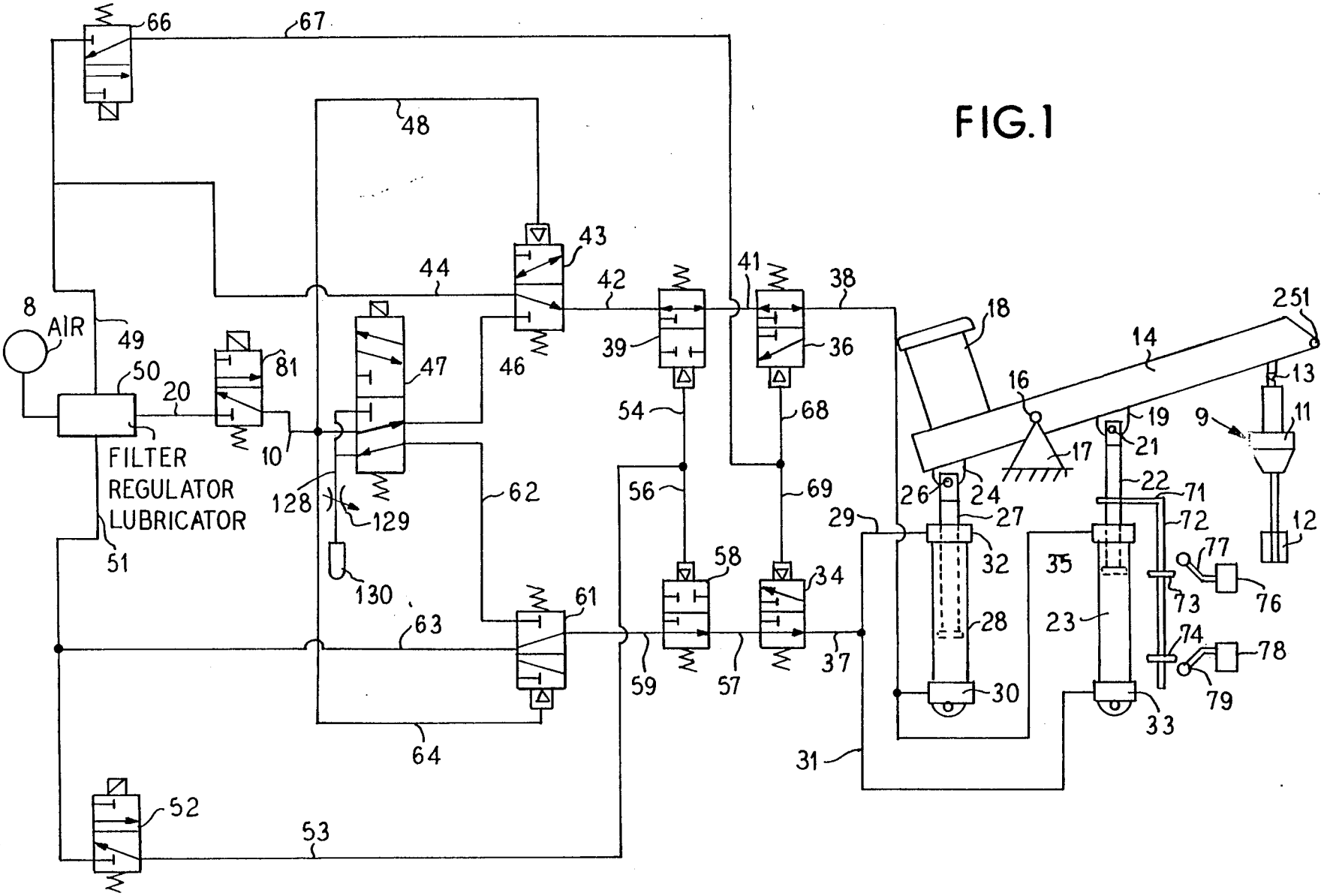
FIG. 1 is a schematic view illustrating the air control system of the lever arm for the honing head.

FIG. 1 illustrates the pneumatic control system for operating a honing machine which includes elements 18, 14, and 9. The honing machine includes a motor 18 which drives a honing tool 12 which can be used to hone the inside of the cylinder walls of an engine for example. The honing tool (11, 12) or (9) is connected by a pivot and U-joint 13 to a pivoted beam 14 which is pivotally supported on a pivot shaft 16 from a support 17. A spring counter balance and motor (18) are mounted on the end of the beam away from the honing tool 9 as shown. A first bracket 19 is mounted on one side of the pivot 16 and is connected by a pivot pin 21 to a piston rod 22 which is connected to a piston mounted in a cylinder 23 which can be air operated. A bracket 24 is mounted on the other side of the pivot 16 and is connected by pivot pin 26 to a piston 27 of an air cylinder 28. An airline 29 is connected to the upper end

32 of cylinder 28. An airline 31 is connected to the air line 29 and is connected to the lower end 33 of the cylinder 23. A line 37 is connected to the air lines 29 and 31 and is connected to a three-way air piloted valve 34. An air line 57 connects the valve 34 to a three-way air piloted valve 58. An air line 59 connects the valve 58 to a three-way air piloted valve 61. A line 63 connects the valve 61 to a line 51 which is connected to a filter regulator lubricator 50 which is connected to an air supply 118. An air line 38 is connected to the lower end 30 of the cylinder 28 and to the upper end 35 of the cylinder 23. The air line 38 is connected to a three-way piloted valve 36. An air line 41 connects the valve 36 to a three-way air piloted valve 39 and an air line 42 connects the valve 39 to a three-way air piloted valve 43. Air line 44 connects the valve 43 to line 49 which is connected to the filter regulator lubricator 50. A three-way solenoid operated air valve 66 is connected to line 49 and to airline 67 which is connected to airline 68 and 69 which are respectively connected to the valves 36 and 34. A three-way solenoid operated air valve 81 is connected by line 20 to the filter regulator lubricator 50 and to a line 10 which is connected to lines 48 and 64. Line 10 is connected to a four-way solenoid operated air valve 47 which has a line 128 which is connected to a needle valve 129 which has its other side connected to an air muffler 130.

A line 48 is connected to line 10 and is connected to the three-way air piloted air valve 43. A line 64 is connected to the line 10 and is connected to the three-way air piloted valves 61. A three-way solenoid air valve 52 is connected to line 51 which is connected to the filter regulator lubricator 50 and to the air supply 8. The three-way solenoid air valve 52 is connected by airline 53 to air lines 54 and 56 which are respectively connected to three-way air piloted valves 39 and 58.

A bracket 71 is attached to piston rod 22 and carries a threaded shaft 72. A first trip disc 73 is threadedly mounted on shaft 72 and is engageable with an actuating arm 77 of an upper limit switch 76. A second trip disc 74 is threadedly mounted on shaft 72 and is engageable with an actuating arm 79 of a lower limit switch 78.

Figure 2:
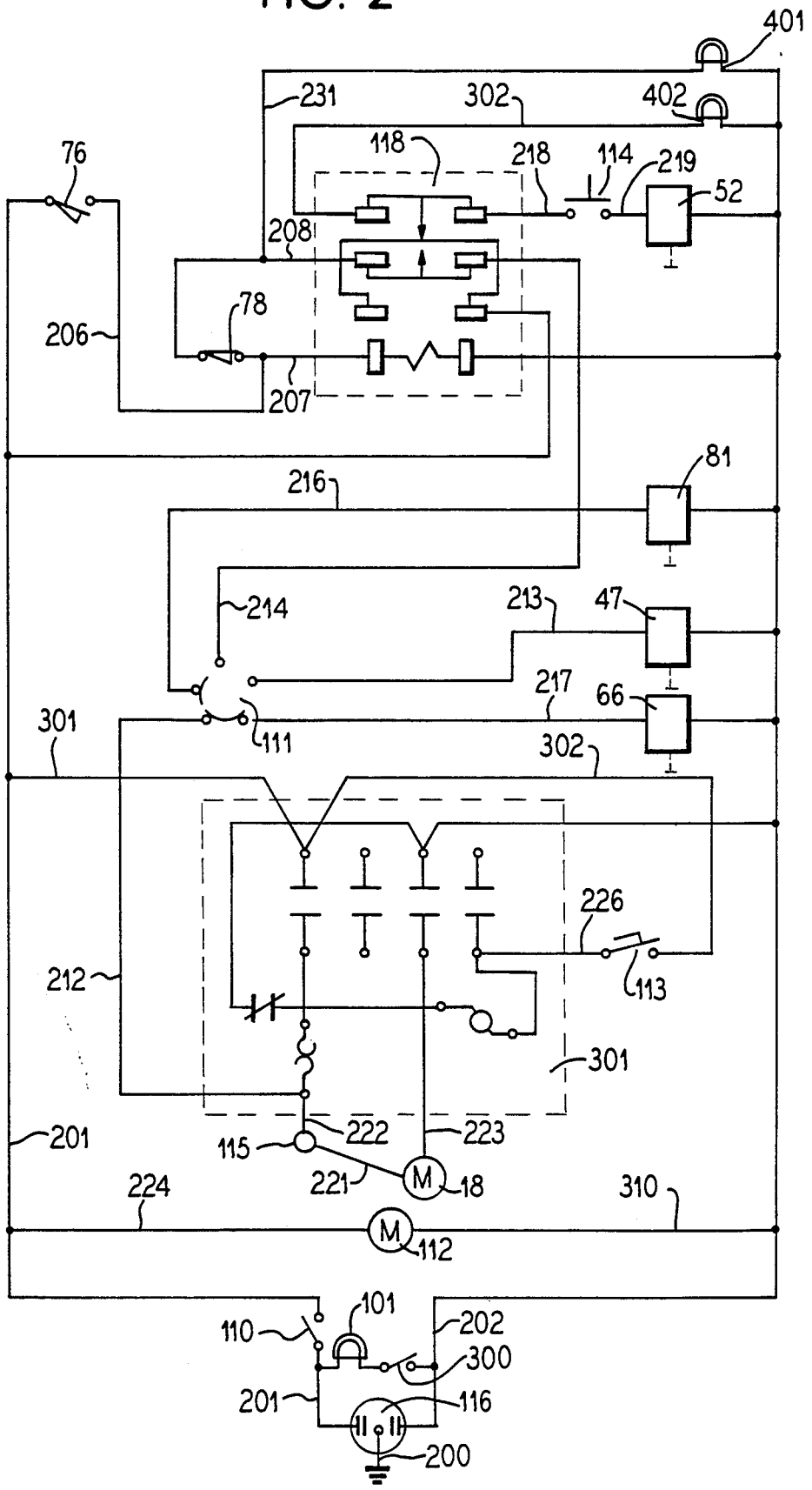
FIG. 2 is an electrical schematic of the system.

FIG. 2 is the electrical schematic of the invention which shows an electrical power plug 116 which can be connected to a suitable power source. The power plug has a grounded lead 200 and power leads 201 and 202. A work light 101 and switch 300 are connected across leads 201 and 202. A main power switch 110 is connected in line 201. The pump motor 112 is connected across leads 201 and 202 when switch 110 is closed. The limit switches 76 and 78 are connected to line 201 and to a power relay 118 by lines 206, 207 and 208. A manual-/auto switch 111 is connected by line 212 to a motor starter 301 and by line 213 to the solenoid valve 47. The switch 111 is connected by a line 214 to the relay 118 and by line 216 to the solenoid valve 81. The switch 111 is connected by line 217 to the solenoid valve 66. A push button switch 114 is connected by line 218 to the relay 118 and the switch 114 is connected by line 219 to the solenoid valve 52. A load meter 115 is connected by line 221 to the motor 18 and the line 222 connects the load meter 115 to the motor starter 301 and to lead 212. The motor 18 is connected by a lead 223 to the motor starter 301.

The pump motor 112 is connected by line 224 to the power lead 201 and by lead 310 to lead 202. The foot switch 113 is connected to power by line 302 and is connected by line 226 to the motor starter 301. A first indicator light 401 is connected by a lead 231 to the relay 118 and to lead 202. A second indicator light 402 is connected to lead 202 and by lead 302 to the relay 118.

When the switch 111 is in the manual mode, it energizes the solenoid valve 66 which causes the valves 36 and 37 to dump air pressure to atmosphere and the operator can operate the lever arm 14 up and down manually to hone the work piece.

When the switch 111 is in the auto mode, the pivot arm 14 oscillates up and down. The solenoid valves 81 and 47 supply air through valves 43, 39 and 36 to cause the pivot arm to move the tool 9 downwardly until the disc 74 engages arm 79 to close switch 78. This causes the solenoid 47 to deactuate valves 43, 39 and 36 and to actuate valves 61, 58 and 34. This applies air pressure through line 31 to cylinder 23 and through line 29 to cylinder 28 to move the honing tool 12 upwardly until the disc 73 engages arm 77 to close limit switch to again reverse the direction of the pivot arm 14.

When push button 114 is pushed, it actuates solenoid 52 which causes valves 39 and 58 to cause the tool 12 to remain in the down position to hone as long as desired.

In operation, when the main power switch 110 is closed, power is applied to the system and with the auto manual switch 111 in the manual mode, solenoid valve 66 is actuated causing the valves 43, 39 and 36 to dump air from the cylinders 28 and 23 to atmosphere thus eliminating resistance to movement. The pivoting arm 14 is counter balanced by the weight and motor 118 and by springs so as to neutralize any weight biasing in the manual mode. The foot switch 113 when closed energizes the hone head motor 18 so as to allow honing and the operator can move the honing tool 11 up and down in the cylinder by using the hand grip 251.

When the unit is switched to the auto stroke mode by moving the switch 111 to the auto stroke position, the electrical circuit is connected to the foot switch 113 for power. Initially, the trip discs 73 and 74 are adjusted by rotating them on a threaded shaft 72 to the desired position for a suitable stroke for the honing tool 112. The upper trip discs 73 is positioned such that the upper limit switch 76 will make contact and light indicator lamp shows that contact has been made. It is to be noted that the member 71 is connected to the piston rod 22 so that the shaft and discs 73 and 74 move with the piston rod 22. The process is repeated for the lower trip disc 74 and the lower limit switch 78. The pivot arm 14 is then positioned such that the trip disc 73 and 74 are between the limit switches 76 and 78 or at least between their actuating arm 77 and 79. When the foot switch 113 is actuated, automatic stroking occurs which energizes the motor 18 to start the honing tool 12. The stroke speed is controlled by the flow control valve 129. Opening the valve 129 increases the air flow and increases the speed of the pivot arm 14.

The invention also provides an additional circuit in the control so as to allow the hone tool 12 to stop at the bottom of the cylinder to remove any taper that is developed due to piston wear. This dwell feature is controlled by activating air solenoid 52 which causes valves 39 and 58 to close locking the head. The dwell circuit is connected such that it will always stop in the down position. The dwell can be used to jog the honing head 12 upward until the upper limit switch 76 is tripped and then the tool 12 indexes back to the bottom limit switch 78.

It is to be realized that the pivot arm 14 continues to pivot due to the action of the cylinders 23 and 28 causing the honing tool 12 to move up and down in the cylinder which is being honed until the operator terminates the operation as, for example, when the cylinder has been honed to the proper size.

It is seen that the present invention provides novel control circuit for a honing tool and although it has been described with respect to preferred embodiments, it is not to be so limited as changes and modifications may be made therein which are within the full intended scope as defined by the appended claims.

We claim as our invention:

1. A control circuit for an automatic honing machine comprising, a pivot shaft, a frame pivot arm pivotally supported by said pivot shaft from said frame, a honing tool pivotally connected to one end of said pivot arm for honing an engine block, a first pneumatic cylinder with a piston rod which extends from one end pivotally attached to said pivot arm on one side of said pivot shaft and with its other end connected to said frame, a second pneumatic cylinder with a piston rod which extends from one end pivotally attached to said pivot arm on a second side of said pivot shaft and with its other end connected to said frame, a pair of spaced trip discs attached to the piston rod of said first cylinder, an upper and a lower limit switch spaced from each other and, respectively, engageable by said pair of spaced trip discs as said piston of said first cylinder moves, a source of compressed gas, and a control means connected to said source of compressed gas, to said upper and lower limit switches and to said first and second cylinders to control the up and down movement of said pivot arm so as to cause said honing tool to hone said engine block, including means for adjusting the distance between said pair of spaced trip discs to vary the amount of movement of said pivot arm, wherein said control means includes a first solenoid valve, a control switch connected to said solenoid valve and first piloted valves means connected to said first solenoid valve and to said first and second cylinders to move said pivot arm in a first direction and second piloted valve means connected to said first solenoid and to said first and second cylinders to move said pivot arm in a second direction, wherein said first piloted valve means includes first, second and third piloted valves, wherein said second piloted valve means includes fourth, fifth and sixth piloted valves, and including a third solenoid valve connected to said second and fifth piloted valve means to hold said honing tool in the down position and a push button switch for engaging said third solenoid valve.

2. A control circuit for an automatic honing machine according to claim 1 including a second solenoid valve connected to said third and sixth piloted valves for releasing air pressure so that said pivot arm may be manually moved.

3. A control circuit for an automatic honing machine according to claim 1 including a fourth solenoid valve connected to said first solenoid valve.

* * * * *